US005170005A

United States Patent [19]

Mabry et al.

[11] Patent Number: 5,170,005

[45] Date of Patent: Dec. 8, 1992

[54] SYSTEM FOR UNDERWATER STORAGE AND LAUNCHING OF ROCKETS

[75] Inventors: John P. Mabry, Portsmouth, Va.; Joseph W. Smith, Asheville, N.C.; Bromley C. Jinnette, Hendersonville, N.C.

[73] Assignee: Newport News Shipbuilding and Dry Dock Company, Newport News, Va.

[21] Appl. No.: 767,648

[22] Filed: Sep. 30, 1991

[51] Int. Cl.[5] ..... F41F 3/07; F41F 3/042

[52] U.S. Cl. ..... 89/1.81; 89/1.11

[58] Field of Search ..... 89/1.809, 1.810, 1.11, 89/1.8

[56] References Cited

U.S. PATENT DOCUMENTS

| | | | |
|---|---|---|---|
| 2,818,807 | 1/1958 | Tracey | 102/411 |
| 3,158,062 | 11/1964 | Feiler | 89/1.810 |
| 3,166,979 | 1/1965 | Draim | 89/1.809 |
| 3,295,411 | 1/1967 | Lehmann | 89/1.810 |
| 3,838,642 | 10/1974 | Shimberg | 89/1.809 |
| 3,981,152 | 9/1976 | Funston | 89/1.809 |
| 4,003,291 | 1/1977 | Vass et al. | 89/1.810 |
| 4,274,333 | 6/1981 | Lampton | 102/418 |
| 4,395,952 | 8/1983 | Hickey | 89/1.810 |
| 4,586,421 | 5/1986 | Hickey et al. | 89/1.810 |

*Primary Examiner*—David H. Brown
*Attorney, Agent, or Firm*—Lalos & Keegan

[57] ABSTRACT

An underwater rocket launch system for launching a rocket from deep water includes a capsule for containing the rocket, the capsule being constructed of a thin walled, dual hull to provide a positive buoyancy with a highly pressurized gas introduced within the space between the hulls to offset the external pressure of the water. A releasable anchor pod is attached to the underside of the capsule that becomes separated in water to cause the capsule to sink and remain anchored to the bottom. The capsule may be remotely released from the anchor pod upon receipt of a coded ELF signal so that the capsule rises to the surface whereupon the rocket is automatically launched.

25 Claims, 7 Drawing Sheets

SYSTEM FOR UNDERWATER STORAGE AND LAUNCHING OF ROCKETS

FIELD OF THE INVENTION

The present invention relates generally to a rocket launch system for launching a rocket at sea, and more specifically, to a rocket launch system in which a rocket-containing capsule is covertly prepositioned on continuous standby at a great depth underwater. Upon command, the capsule rises to the ocean surface where the rocket is automatically launched.

BACKGROUND OF THE INVENTION

In recent years, there has been an increased demand from the defense sector for an improved rocket launching capability from locations in various parts of the world, particularly for reconstituting military satellites that have been disabled by enemy action.

In military operations, the location and the speed of a rocket launch are oftentimes critical, whether the purpose of the launch is to deliver a warhead or for satellite reconstitution. It is frequently desirable to launch such rockets from within the vast regions covered by the oceans, and hence the need for a suitable system for the storing and launching of rockets particularly from deep parts of the ocean, such as at ocean depths of 10,000 feet and greater.

One type of known underwater weapon system uses an elongate outer container buried or partially buried in an upright position on the seabed of the floor of a body of water. Such a system is disclosed in U.S. Pat. Nos. 4,395,952 and 4,586,421 to Hickey. In the earlier of the two patents, pumps on either end of the container move silt, gravel, etc., from the bed of the sea so that the container can be buried or partially buried. The container is raised from its buried position by reverse operation of the pump at a time when the weapon is to be activated. In both patent disclosures, an inner container houses the weapon as a self-propelled device with guidance means. Ejection of the weapon from the container is accomplished by pressurized gas or from a chemical generating means, such as an explosive device. However, such a system has drawbacks in that it requires the use of rotary displacement equipment or pump means on the container for displacing the sand or silt on the bottom of the sea so that the container can become partially buried in an upright position in the seabed, as well as equipment to accomplish the selfpropulsion of the weapon through the water.

There has also been proposed the use of a highly buoyant mine anchored in deep water which when released from the anchor travels upwardly in the water towards a target, with the buoyancy of the mine being used as the upwardly propelling force. Deployment is from an aircraft, from the torpedo tube of a submarine, or from a surface vessel. The maximum operating depth, however, is only on the order of 500 fathoms. An anchor and sufficient cable is paid out so that the mine is maintained in a vertical position a predetermined distance from the bottom of the ocean and the target-seeking mine uses guidance controls in conjunction with listening circuitry to detect the presence of a moving ship or submarine. A tracking circuit guides the mine toward the target ship once it is released from the anchor. However, such a system, as is described in U.S. Pat. No. 4,274,333 to Lampton, is limited by its operational depth while also involving complex mechanisms in a system that operates solely underwater.

For above-water launching from a submerged position, it is known, for example, to use an outer capsule having an inner chamber, with a separate nose section and a fin connected to a tail section of the outer capsule. The inner chamber contains a supporting ring affixed to the inner wall of the chamber that supports the rocket. The nose section, fastened to the capsule's main body, is released by a detachable connector activated by an electrically detonated explosive device that allows for ejection of the rocket from the capsule. Deployment of the rocket-containing capsule is made underwater from a submarine, with buoyant forces then acting to cause the capsule to rise to the surface. A sensor, such as a hydrostatic switch or a double integrating accelerometer, activates an automatic launch of the rocket when the capsule reaches the surface of the water. This type system, though, offers no capability for storage underwater and requires manpower for release of the capsule in the launch area.

Another type of underwater rocket launching system is described in the patent to Lehmann, U.S. Pat. No. 3,295,411, in which a capsule, placed in the water by a submarine or by a surface vessel, hovers in the water. At the time of launch, the capsule floats to the surface where the rocket is ejected by compressed air. A prominent feature of the hovering system is the positive or negative buoyancy that it provides by means of an automatic adjustment of the ballast to maintain the capsule at a predetermined hovering depth. The hovering feature, however, has drawbacks in that it limits the effective time duration in which the system can be stored underwater, and also reduces the position control of the capsule that can be affected by various underwater currents and other movements.

Various ancillary devices have also been developed in connection with underwater launches. For example, in the area of release mechanisms, soluble linkage strips are known where the timed dissolvement from the water of linkage strips of gelatinous material serves as a release to cause buoyant objects to rise to the surface. Such a release is as described in U.S. Pat. No. 2,818,807.

Also in underwater launch systems it is known to use damping plates to control the up and down movement of a rocket engine in water. In the patent to Draim, U.S. Pat. No. 3,166,979, for instance, a rocket igniter and damping plate assembly is described in connection with a rocket in water operating in a floatable upright position. The rocket contains a rocket engine having a circular plate mounted on the bottom of the engine extending beyond the sides of the rocket to dampen the up and down movement as the rocket floats in the water. The damping plate is expelled from the rocket engine at the time of launch when a rubber or plastic bag on the assembly is ruptured by gases generated by the rocket engine when it is fired.

Although known systems such as those described above are suitable for the releasing of underwater mines or capsules and in providing an above surface launch capability, they have drawbacks in meeting the need for a deep submergence rocket and capsule having a long-term storage capability that is releasable upon command to provide a surface launch of the rocket. Some proposed solutions that use underwater capsules also require additional equipment or mechanisms that only add to the complexity of the system, and hence impose a greater cost burden as well as the need for maintenance to guard against malfunctioning.

SUMMARY OF THE INVENTION

The present invention has been developed with a view toward substantially solving the above-described disadvantages and has as one of its essential objects to provide a system for long-term prepositioning of a rocket-containing capsule underwater at great depth and in which the rocket can be raised to the surface and automatically launched upon command.

It is also an important object of the present invention to provide such an underwater storage and launch system that is relatively simple in terms of its deployment, its long-term storage, and its launch operation.

A further object of the invention is to provide an improved system for deploying the rocket-containing capsules into the water.

In accomplishing these and other objects, a system for deep underwater storage and for the launching of a rocket is disclosed that comprises a capsule having dual pressurized hulls comprising an inner hull and an outer hull with a pressurized gas between the hulls such that the capsule has a positive buoyancy in water. Stiffening means are connected between the inner and the outer hulls for providing structural support to the capsule in deep underwater storage. An anchor pod is releasably attached to the capsule and includes at least one damping plate, a brake mechanism and an anchor line that passes through the brake mechanism and connects the anchor pod to a damping plate and thus to the capsule. Release means are provided between the capsule and the anchor pod for releasing the anchor pod from the capsule and for causing the capsule with its positive buoyancy to rise towards the water surface, whereupon ejection means within the capsule sense the capsule's position in the water and cause ejection of the rocket from the capsule as a function of that position.

In another aspect of the invention, a method for the underwater storage and launching of a rocket in accordance with the disclosed structure of the system is presented comprising the steps of deploying into a body of water a capsule having dual hulls, forming a gas impervious space between the hulls and introducing a highly pressurized gas into that space, attaching a releasable anchor pod to the capsule, sinking the capsule to a predetermined depth in the water by means of release of the anchor pod such that the anchor pod descends to the bottom of the water, the anchor pod being attached to a predetermined length of anchor line for maintaining the capsule in its underwater position, then releasing the capsule from the anchor pod at a predetermined time, thus permitting the capsule to rise to the surface of the water, and finally launching the rocket from the capsule.

These and other features and advantages of the invention will be set forth in, or apparent from, the detailed description of the preferred embodiments of the invention which follow.

BRIEF DESCRIPTION OF THE DRAWINGS

For a complete understanding of the structure of the invention, reference is made to the following detailed description and the accompanying drawings, wherein.

DETAILED DESCRIPTION OF THE PREFERRED EMBODIMENTS

Figure 1:
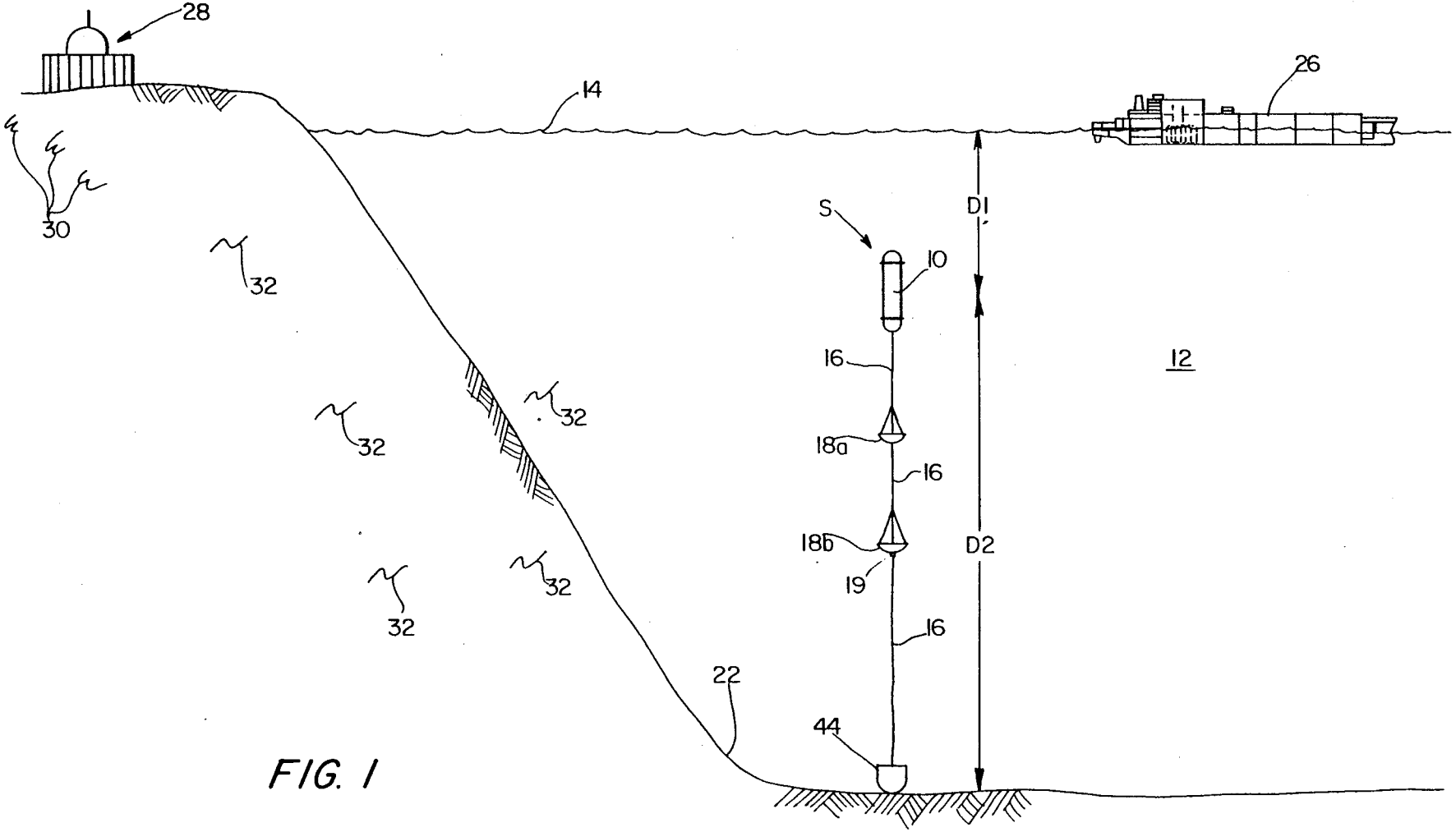
FIG. 1 presents an illustration of the environment in which a rocket is stored underwater according to the system of the invention.

FIG. 1 presents the general environment of the underwater rocket launching system of the invention following deployment to a fixed position at an underwater location. The rocket launching system S includes capsule 10 containing, for instance, a solid propellant rocket with a satellite payload positioned underwater in the ocean 12, at a depth D1 beneath ocean surface 14.

The capsule 10 after deployment is so light in weight that it uniquely is provided with a positive buoyancy and yet so strong as to withstand very high water pressures of depth D1. The positive buoyancy also aids the capsule in remaining in a vertically upright position as shown. As may also be seen in FIG. 2, there is attached to the lower end of the capsule an anchor wire 16 also serving as an extremely low frequency (ELF) antenna. Attached along the length of anchor wire 16 are damping disks 18*a* and 18*b* that provide for a slow descent and ascent of the capsule, as discussed further below. Damping disks 18*a*, 18*b* also serve as an ELF ground plane, while adding to the stability of capsule 10 in the water.

Figure 2:
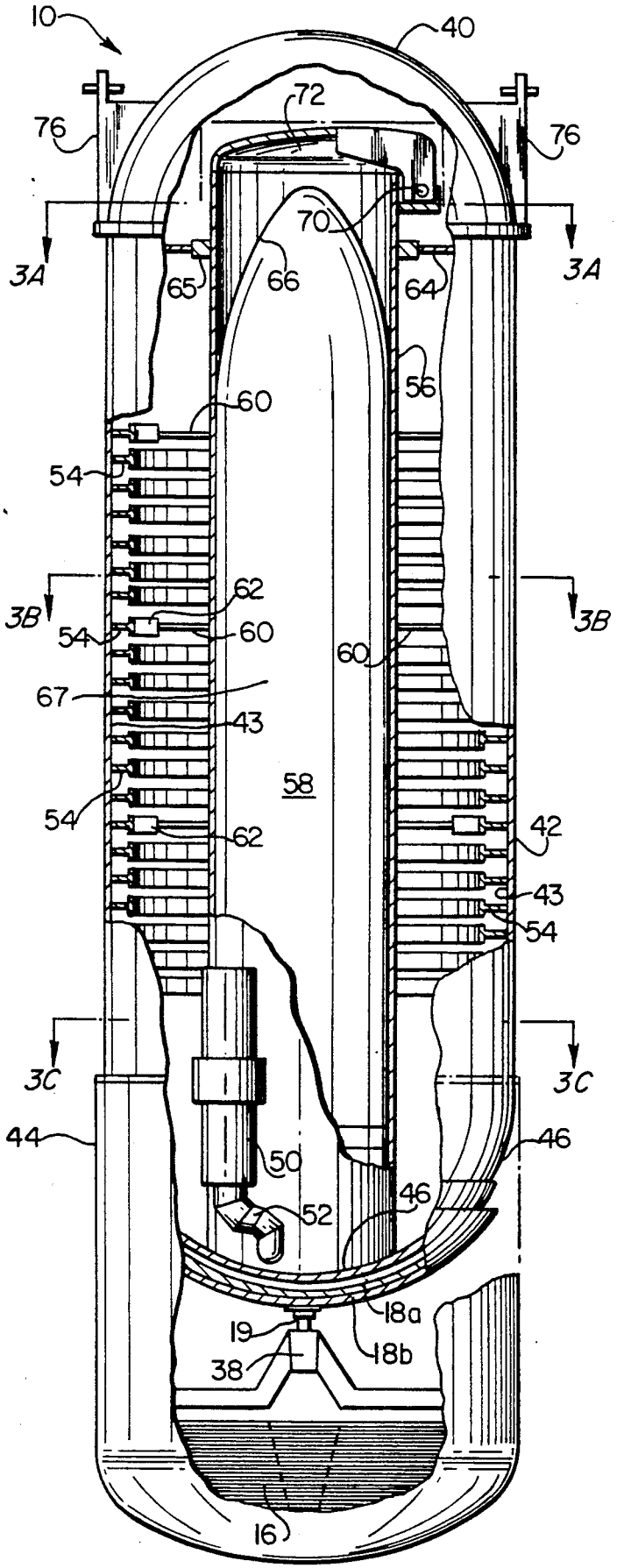
FIG. 2 presents an elevational cutaway view of the capsule with a rocket stored therein.
Figure 6A:
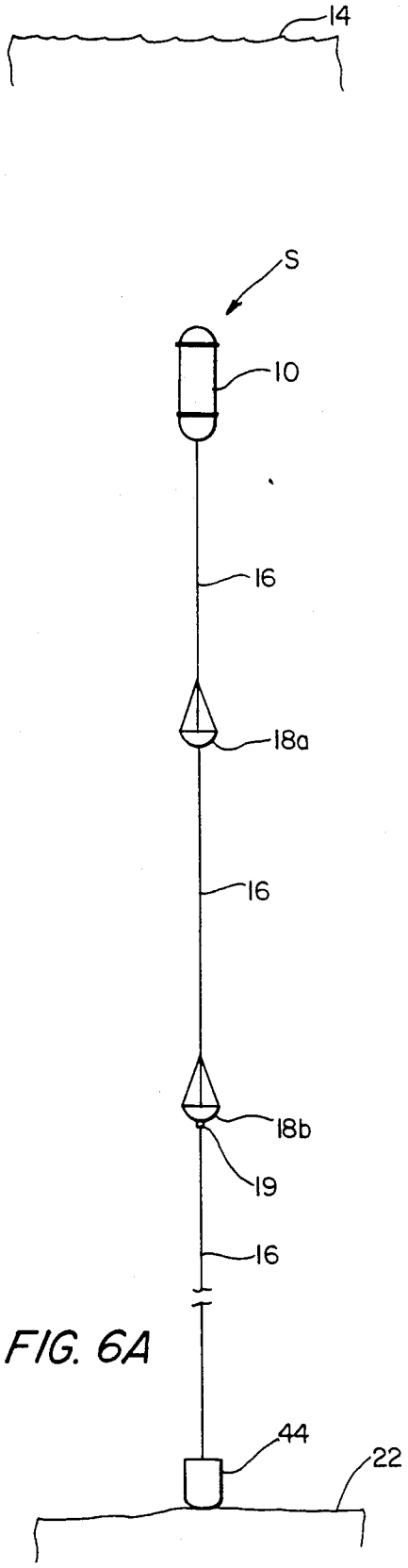
FIGS. 6(A) and 6(B) the release of the capsule from its underwater storage position.
Figure 6B:
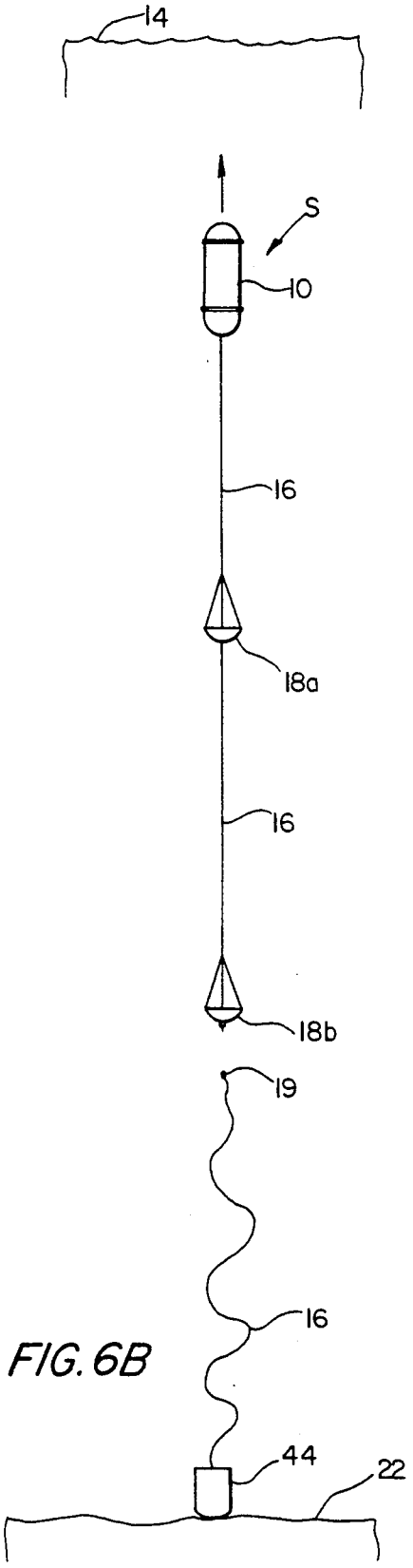
Figure 7A:
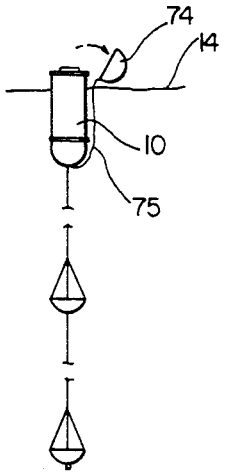
FIGS. 7(A) and 7(B) illustrate the launching of the rocket from the capsule at the surface of the water.
Figure 7B:
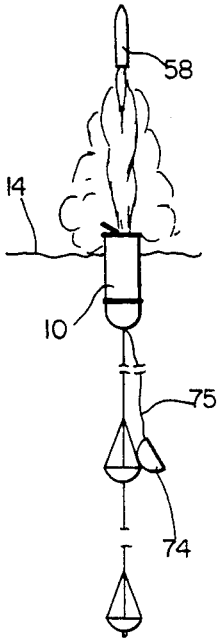

Just beneath lower damping disk 18*b* is a release mechanism 19 that is connected by a lower portion of anchor cable 16 to anchor pod 44 for contact with the ocean floor 22. The capsule, as shown in FIG. 2, with the anchor cables, damping disks, and release mechanism all produce a negative buoyancy, as the view of FIG. 1 demonstrates by the system S remaining on the ocean floor 22. Receipt of coded ELF signals by release mechanism 19 causes release mechanism 19 to release itself and anchor pod 44 from cable 16 so that the capsule 10, the damping disks 18*a* and 18*b* and interconnecting anchor cable 16 are released from the anchor pod 44, as shown in FIG. 6(B). Thereafter, the capsule's positive buoyancy draws the capsule to the surface 14 as shown in FIG. 7(A), from which position the rocket 58 can be launched as shown in FIG. 7(B).

In the preferred embodiment, the rocket launch system S is used in a deep sea environment with distance D1 typically being about 10,000 feet and distance D2 between ocean floor 22 and capsule 10 being greater than 10,000 feet. The rocket launch system S is, however, suitable for use at widely varying ocean depths.

Illustrated also in FIG. 1 is a ship 26 used for transportation and subsequent deployment of a number of underwater capsules. Upon deployment to the position shown in FIG. 1, a launch command facility 28, such as a U.S. national command authority or other launch control station, can generate and transmit coded ELF launch control signals 30 that are transmitted to release mechanism 19 by means of ELF transmission through the earth and the sea, the propagation thereof being represented generally by the symbols designated 32 in FIG. 1.

Figure 4B:
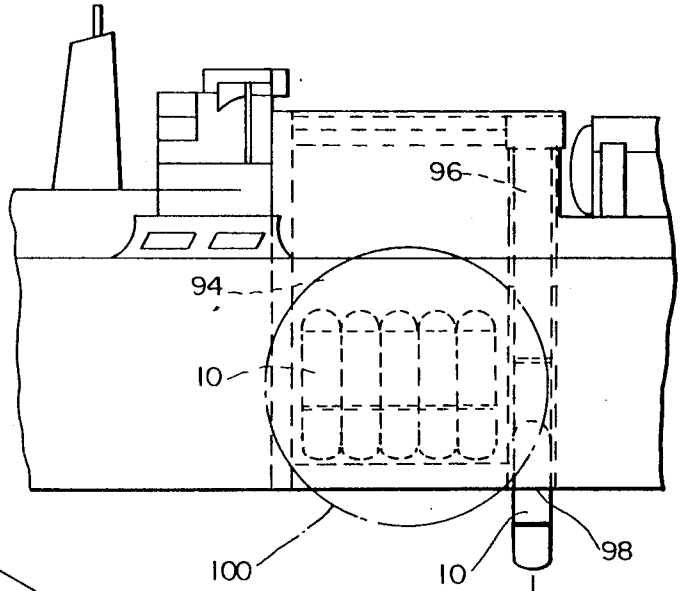
FIGS. 4(A) through 4(C) depict an internal section of the ship used for deployment of the capsule.
Figure 4C:
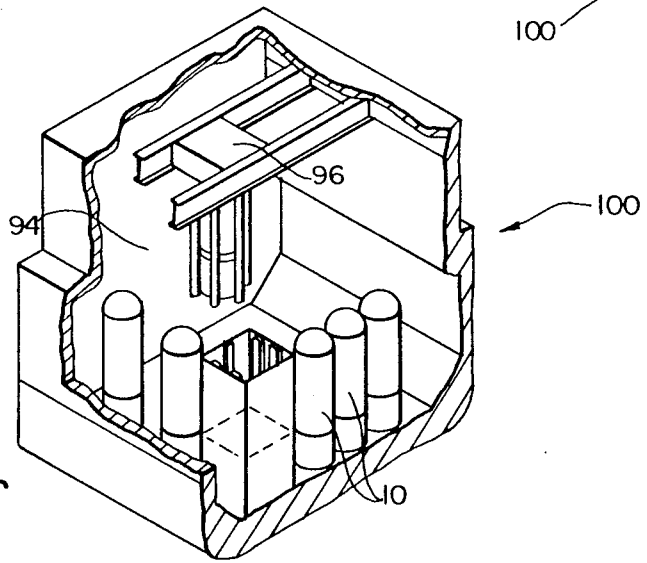
Figure 4A:
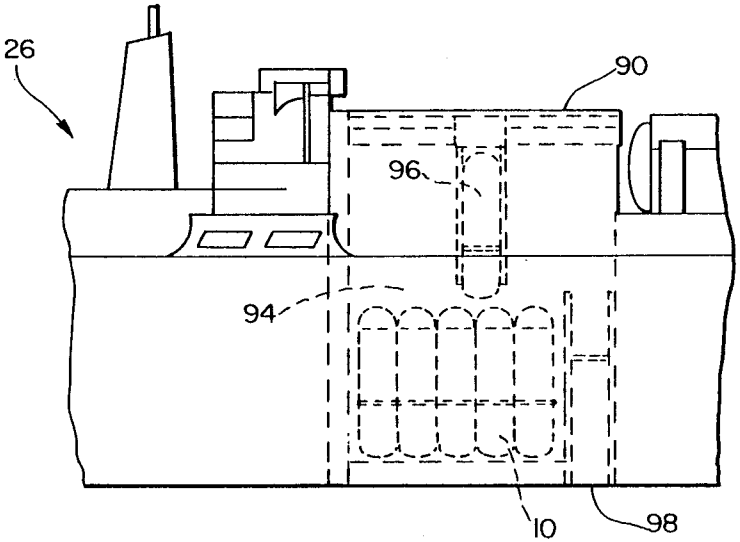

The structure of capsule 10 is shown in FIG. 2 in a vertically upright position, as it would be in storage in the hold of ship 26, as best shown in FIGS. 4(A) through 4(C). The capsule is formed with an elongated outer hull 42. Releasably connected to the top end of outer hull 42 is a capsule top cover 40, generally hemispherical in shape. Integrally connected and sealed at the bottom of hull 42 is a bottom end 46 of capsule 10. The bottom end 46 of capsule hull 42 also has a generally hemispherical shape to withstand the high ambient water pressure at the capsule's intended depth beneath ocean surface 14.

An anchor pod 44 is connected to the bottom end 46 of capsule hull 42 and forms the bottom portion of capsule 10 when in storage and prior to its deployment. Once capsule 10 is deployed into the ocean, anchor pod 44 separates from the capsule hull 42, and descends in the ocean with capsule hull 42 attached.

In anchor pod 44, anchor cable 16 is wound up and attached through cable guide and brake 38 to release mechanism 19. Computer and depth sounder equipment are located in the anchor pod and in the capsule hull, although details of such equipment, known in the art, are not shown in the drawings. Positioned just above release mechanism 19 is lower damping disk 18(*b*) which, in turn, is positioned against upper damping disk 18(*a*). The top surface of upper damping disk 18(*a*) is flush with bottom end 46 of the capsule.

A rocket tube 56 is concentrically disposed within capsule 10 for containment of a rocket (or missile) 58 that has a rocket nose cone 66 containing a particular payload, such as a satellite. A gas generator 50 is attached to an exhaust outlet port 52 pointing downward for expelling rocket 58 at the time of launch.

Rocket tube 56 also forms and serves as a concentric inner hull of the capsule. This inner hull 56 and outer hull 42 form a gas impervious space 67 extending lengthwise within the capsule. The top end of space 67 is bounded by a gas impervious diaphragm 64 connected between inner hull 56 and outer hull 42. Space 67 is sealed by bottom end 46 of the capsule.

Within space 67, a plurality of circular stiffeners 54 are secured circumferentially around the inside surface 43 of the outer hull 42. A plurality of vertically arranged support structures 60 support inner hull 56 concentrically within outer hull 42, as shown in FIG. 2. A slip joint 62 interconnects each support structure 60 with a respective stiffener 54, as shown in FIG. 3(B). Slip joint 62 allows limited relative movement between outer hull 42 and inner hull 56 as the capsule experiences the varying pressures of its environment.

A important aspect of the invention is the achievement of a positive buoyancy in the capsule despite the great water pressures at the depths of interest. The buoyancy force on any body in water is dependent on the amount of water it displaces, that is, on the volume of the body. To have a net positive buoyancy, the body must weigh less than the volume of water it displaces. The hull of the body must also resist the pressure of the water. At a depth D1 of 10,000 feet, for example, the pressure differential across the hull would be approximately 4500 psi. A cylindrical rib-stiffened hull made of a given material, for example steel, must be about four inches thick to withstand this pressure differential. But at the diameters necessary to accommodate a missile, a single hull this thick would always be too heavy to provide positive buoyancy. As the diameter is increased to provide more volume, and therefore more buoyancy force, the thickness of the hull must be increased to maintain adequate strength. The increase in weight consequent to this increase in thickness more than offsets the increased buoyancy force.

The dual hull of the present invention solves this problem by providing part of the hull thickness necessary to withstand stress at a smaller diameter. By reducing the diameter of part of the hull, the total weight for a given volume displacement is reduced.

In the dual hull of the present invention, the outer hull 42 may be relatively thin, e.g. 2.75 inches, and the inner hull 56 may be even thinner, e.g. 1.125 inches. The preferred construction is steel, although hull construction of other materials or material mixtures would also be possible. Space 67 is filled with a pressurized gas, such as helium pressurized to 1000-3000 psi, but on the order of 2000 psi in the preferred embodiment.

This arrangement means that at a depth of 10,000 feet, for example, where the water pressure is about 4500 psi, outer hull 42 must withstand a differential pressure of only 2500 psi (4500 psi water pressure minus 2000 psi in space 67) while inner hull 56 must withstand only the 2000 psi pressure of space 67. Since the inner hull 56 is smaller in diameter than outer hull 42, the total weight of the dual hull capsule is less than if the entire thickness of the hull were located at the same diameter as that of outer hull 42.

This margin is not overly large, as might be expected. In the preferred embodiment, in fact, it is so low that the pressurizing gas in space 67 must be less dense than air. Air at 2000 psi is so dense that it would negate the gain in buoyancy force resulting from the dual hull. A less dense gas, such as helium, is necessary in this application. This pressurized gas, in combination with the rigid support formed between the inner and outer hulls, provides a capsule capable of withstanding the extreme water pressures, up to 4500 psi, encountered at depths equal to or greater than 10,000 feet below the surface. Thus, with the dual hull and the gas pressurized area 67, the capsule of the present invention may be deployed on the ocean floor for as long as up to five years at a 10,000 foot nominal depth.

Figure 3A:
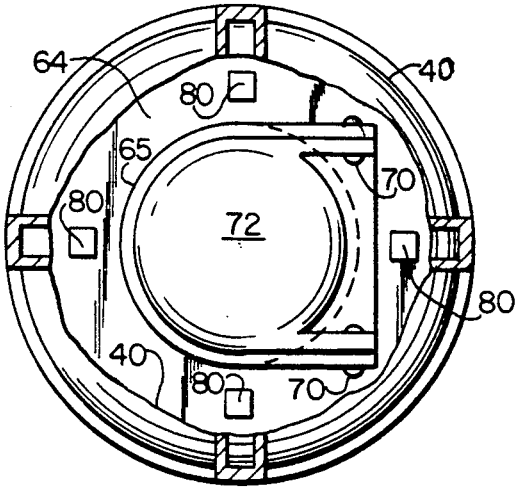
FIG. 3(A) through 3(C) show three cross-sectional views at three points of the capsule of FIG. 2.
Figure 3B:
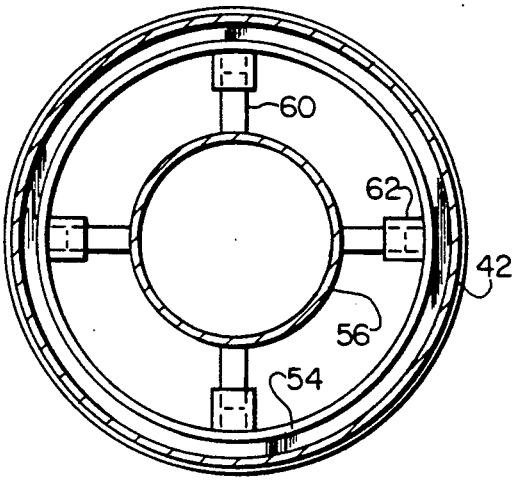

As best shown in FIG. 3(A), the top portion of rocket tube 56 comprises a muzzle hatch 72 secured at one end to the top of rocket tube 56 by hinges 70. Above the muzzle hatch is capsule a top cover 40 that seals the top of the capsule, and is removable from the top of capsule hull 42 by explosive bolts (not shown). Capsule lifting pads 76 (FIG. 2) are positioned vertically upright on two opposing sides at the contact point of the capsule top cover and the capsule hull.

Figure 3C:
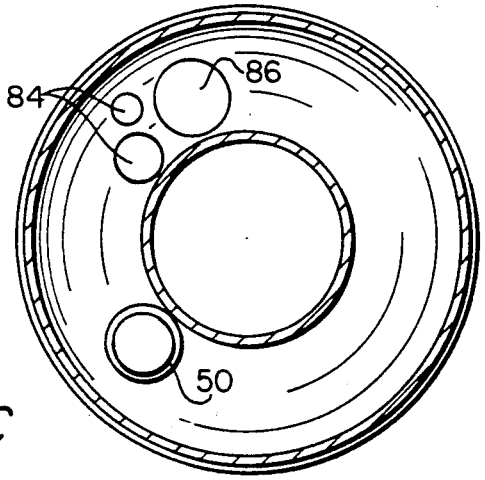

Three cross-sectional views showing the internal structure of capsule 10 are presented in FIGS. 3(A) through 3(C). FIG. 3(A) shows a cross-sectional view along line 3A—3A of FIG. 2, looking downwardly into capsule 10. Removable top 40 is shown in cut-away view around the circular perimeter of the capsule. Diaphragm 64 extends from outer hull 42 inwardly to a diaphragm retaining ring 65. Four one-way vents 80, equally spaced around the capsule, serve as outlets at the time of launch for pressurized gas between inner hull 56 and outer hull 42, while also preventing water from entering in the opposite direction. Muzzle hatch 72 is shown in top view attached at two points to hinges 70 thereby allowing the muzzle hatch to be pivoted upwardly about hinges 7 at the time of launch.

FIG. 3(B) shows a view looking downwardly in cross-section along line 3B—3B of FIG. 2. Inner hull 56 (i.e. rocket tube) is shown connected to outer hull 42 by support structures 60 that connect to slip joints 62 that are attached to stiffeners 54.

FIG. 3(C) presents a cross-sectional view along line 3C—3C of FIG. 2, showing some of the additional components within the capsule. These include gas generator 50, rocket support equipment 84, and compartments for miscellaneous system equipment 86. Other components well known in the art, such as power supply equipment, are also included although not shown in FIG. 3(C).

Referring to FIGS. 4(A) through 4(C), details of the structure of the ship 26 for use in transporting, storing and deployment of the launch capsule are shown. FIG. 4(A) shows a partial side view of the basic structure of ship 26.

Capsule storage 94 is located in a cargo hold, as shown in FIG. 4A. Capsules 10 are depicted by the dotted lines within capsule storage 94. Capsules 10 have rockets 58 positioned in them. An overhead crane 96 is positioned so as to be capable of grasping a capsule 10 and moving it over access port 98 for deployment into the ocean. With this arrangement, the entire deployment operation is able to be performed covertly below deck 90 of ship 26.

FIG. 4(B) is similar to FIG. 4(A) except that it shows a capsule 10 exiting through access port 98. Thereafter, overhead crane 96 is moved over to cargo hold area 94 (FIG. 4A) to begin the transfer of another capsule 10 for the next deployment.

FIG. 4(C) presents a cut-away perspective view of the capsule storage area of FIG. 4(B) designated by encircled area 100 FIG. 4(C) illustrates the operation of overhead crane 96 in grasping and transferring capsules 10 from their storage are 94.

In another embodiment (not shown), rockets of various types may be stored in holds separately from capsules 10. An overhead crane with access to all holds may move capsules from storage in hold 94 to a position over port 98. Then, the crane may retrieve a particular rocket, depending on the purpose desired, from another hold and move it into position over port 98 for placement in a capsule. While this requires more handling at sea, it does increase versatility.

Figure 5A:
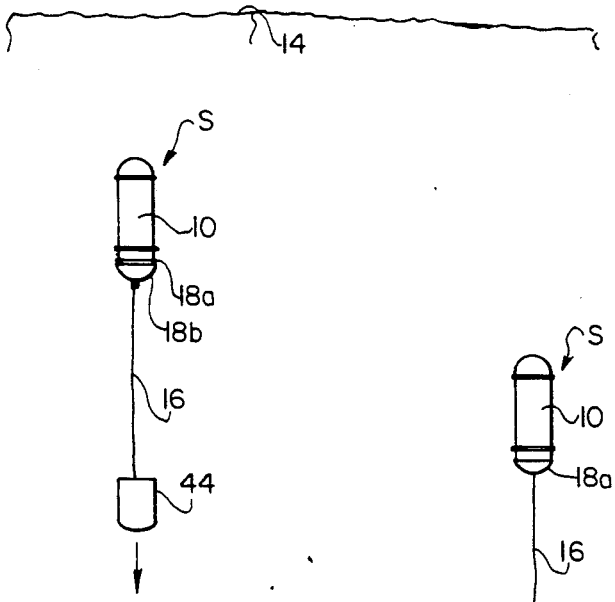
FIGS. 5(A) through 5(C) illustrates various stages of the descent of the capsule after deployment.
Figure 5B:
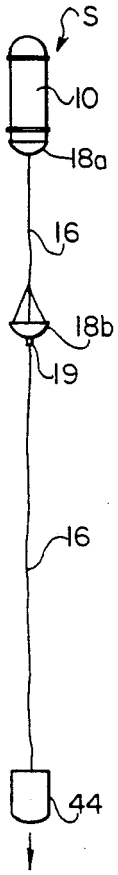
Figure 5C:
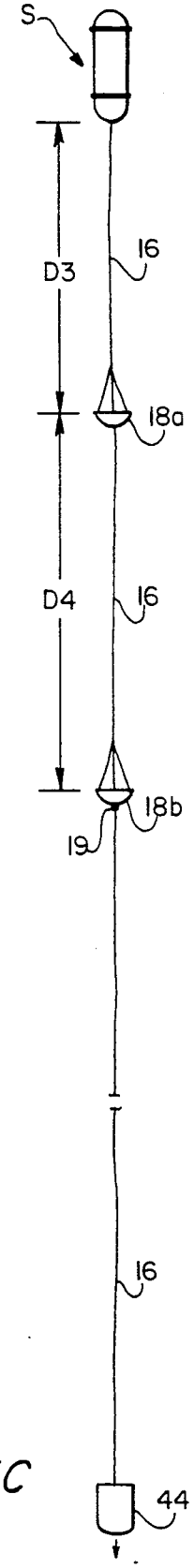

Referring next to FIGS. 5(A) through 5(C), the sequence of steps in positioning the launch capsule below the ocean surface is illustrated.

FIG. 5(A) depicts capsule 10 shortly after being released into the ocean from access port 98 of the ship. The anchor pod 44 has been released from capsule 10 and sinks at a greater rate than capsule 10 due to the action of brake mechanism 38 and the negative buoyancy of the anchor pod. The cable guide and brake 38 (FIG. 2) at the top of anchor pod 44 releases anchor cable 16 at a rate as required by the anchor pod 44 as it descends to the ocean floor 22. Through the use of a computer and depth sounder located within anchor pod 44 and within capsule 10, the anchor cable is let out at a rate that ensures that anchor pod 44 reaches the bottom 22 at approximately the same time as capsule 10 reaches its predetermined depth D1 (FIG. 1).

The computer and depth sounder equipment within capsule 10 are shown as elements 86 in FIG. 3(C). Upper and lower damping disks 18(*a*) and 18(*b*) are separately released from the base of the capsule, as illustrated in FIGS. 5(B) and 5(C). The distance D3 from capsule 10 to upper damping disk 18(*a*) is fixed, as is distance D4 between upper damping disk 18(*a*) and lower damping disk 18(*b*).

As the capsule descends, both damping disks assist in controlling the rate of descent. Although two damping disks are used in the preferred embodiment shown, it will be understood that a fewer or a greater number of damping disks may be used along cable 16 depending upon the depth of the ocean floor and other environmental factors.

It should be noted that FIGS. 5(A) and 5(B) show the positioning of the capsule 10 and attached anchor pod 44 relative to one another with the capsule descending but the anchor pod descending at a faster rate. FIG. 5(C) shows the anchor cable 16 fully extended with both damping disks released from anchor pod 44. This would occur with capsule 10 deeper below the surface 14 than shown in FIGS. 5(A) and 5(B) at the time of full deployment of both damping plates. Therefore, water surface 14 is omitted in FIG. 5(C) and is not presented in a position relative to FIGS. 5(A) and 5(B).

Once anchor pod 44 has reached ocean bottom 22, the capsule will be at its predetermined depth D1 beneath ocean surface 14 as depicted in FIG. 1. At this time, cable guide and brake 38 locks onto anchor cable 16 to hold capsule 10 at its predetermined depth D1 in the ocean, as shown in FIG. 6(A). The capsule will stay at this depth until an ELF signal is received by the anchor release mechanism. Time of underwater stationing for the system described is up to 5 years approximately.

Activation of the launch of the rocket begins with coded ELF launch control signals 30 being sent out from launch command facility 28, and propagated through the earth and sea as signals 32 in FIG. 1. Upon receipt of the coded signals, the capsule's internal systems are activated and release mechanism 19 causes a disconnection of the anchor from the rest of the underwater assembly. The capsule then rises to the surface by its positive buoyancy, as shown in FIG. 6(B). Damping disks 18(*a*) and 18(*b*) ascend with capsule 10 and provide stabilizing control during the ascent, as well as at the time of the previous descent of the capsule.

Figure 8:
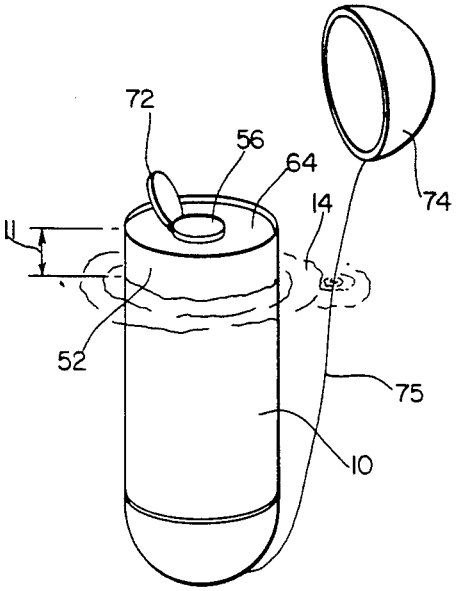
FIG. 8 is an enlarged view of the ejection of the top cover of the capsule at the water's surface.

When the capsule reaches the surface 14, high pressure gas located between outer hull 42 and inner hull 56, is vented out through vents 80 (FIG. 3A) as removable top 74 is jettisoned. This is illustrated in FIG. 7(A) and the enlarged view of FIG. 8. Removable top 74 is saved by means of a tether line 75 that keeps it attached, after jettisoning, to the underside of capsule 10. With the jettisoning of the removable top, muzzle hatch 72 opens and rocket 58 is launched in a manner as depicted in FIG. 7(B). At the time of launch, approximately one foot of the top portion of the capsule extends above the ocean surface, as indicated by the numeral in FIG. 8. Diaphragm 64, visible in FIG. 8 where removable top 74 has been jettisoned, prevents ingress of water into space 67.

Figure 9A:
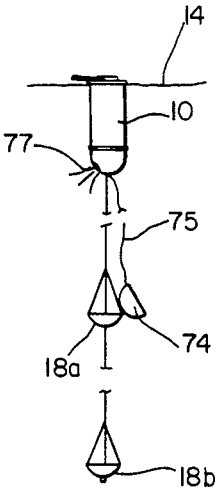
FIGS. 9(A) and 9(B) illustrate the scuttling or retrieval of the capsule after launch.
Figure 9B:
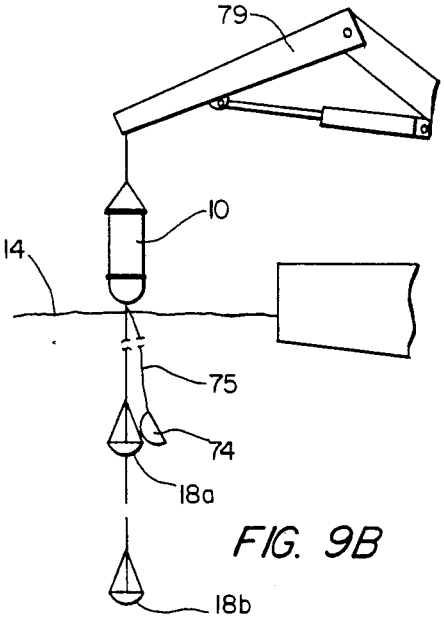

Once the rocket is launched, the capsule may be scuttled by an explosive device automatically activated to blow out a hole 77 in the side of the capsule, as shown in FIG. 9(A). One-way vents 80 allow egress of air from space 67 as it is flooded. Alternatively, the capsule may be recovered by various means, such as by use of a shipboard crane 79 as illustrated in FIG. 9(B).

I will be understood by those skilled in the art that t although the invention has been described in relation to exemplary preferred embodiments thereof, variations and modifications may be effected in these preferred embodiments without departing from the scope and spirit of the invention.

I claim:

1. A system for deep underwater deployment and launching of rockets comprising:

a capsule comprising an inner hull and outer hull forming a gas impervious space therebetween, said gas impervious space being pressurized by a gas to reduce a pressure differential across said outer hull, said inner hull of the capsule forming an inner tube for storing a rocket within the capsule, an anchor pod releasably attached to the capsule, release means connected between the capsule and said anchor pod for releasing said anchor pod from said capsule and allowing the capsule to rise towards the water surface, and means for launching said rocket from said inner tube.

2. A system according to claim 1 wherein said pressurized gas between said inner and outer hulls is helium gas at 1,000–3,000 psi.

3. The system of claim 1 wherein, said anchor pod includes at least one damping plate, a brake mechanism and an anchor cable and wherein said anchor cable passes through said brake mechanism and connects said anchor and said at least one damping plate to the capsule.

4. The system according to claim 1 wherein the capsule further includes a top end closest to the water's surface, a diaphragm means attached at said top end of the capsule between said inner and outer hulls for providing a top closure to prevent ingress of water into said space containing said pressurized gas between said inner and outer hulls.

5. The system according to claim 1 wherein said outer hull is made of steel having a thickness of approximately 2.75 inches, and said inner hull is made of steel having a thickness of approximately 1.125 inches.

6. The system according to claim 1 wherein said release means comprises means for receiving coded ELF signals to cause said release of said anchor pod from the capsule.

7. The system of claim 1 including, support means connected between said inner and said outer hulls, and wherein said anchor pod has at least one damping plate, a brake mechanism and an anchor cable and wherein said anchor cable passes through said brake mechanism and connects said anchor pod and said at least one damping plate to the capsule.

8. The system of claim 1 including, support means connected between said inner and said outer hulls, said support means including a plurality of stiffeners circumferentially disposed about the inside of the outer hull of the capsule, and a plurality of supports disposed a predetermined distance from one another, each support extending from said inner hull to a respective stiffener.

9. The system of claim 1 wherein, said launching means includes sensing means within the capsule for determining the capsule's position within the water.

10. A system according to claim 9 wherein said sensing means comprises computer and depth sensing means for controlling the descent in water such that said capsule reaches a predetermined depth under the water's surface when said anchor pod reaches the bottom of the water.

11. A system according to claim 1 further including deployment means for deploying said capsule with said anchor pod into water comprising a ship having a plurality of rockets and capsules in cargo hold areas below the deck of the ship, an overhead crane for movement and positioning of a capsule, and an access port on the bottom hull of the ship for discharging of a capsule containing a rocket from the underside of the ship's hull.

12. A system according to claim 11 wherein said rockets are stored separately from said capsules in said ship and said crane provides for movement and positioning of a rocket into a capsule.

13. The system of claim 1 including, support means connected between said inner and said outer hulls.

14. The system according to claim 13 wherein said support means includes a plurality of stiffeners circumferentially disposed about the inside of the outer hull of the capsule and a plurality of supports disposed a predetermined distance from one another, each support extending from said inner hull to a respective stiffener.

15. The system according to claim 14 wherein each said support is connected to a respective stiffener by means of a slip joint.

16. A method for deep underwater deployment and launching of a rocket at sea comprising the steps of:

providing a capsule comprising an inner hull and an outer hull, forming a gas impervious space between said hulls and introducing a pressurized gas into said space to provide said capsule with a positive buoyancy, attaching a releasable anchor pod to said capsule, sinking the capsule to a predetermined depth in the water, providing a rocket in said inner hull, maintaining said capsule in an upright position in the water due to a positive capsule buoyancy at said given depth in the water, releasing the capsule from said anchor pod and permitting said capsule with its positive buoyancy to rise to the surface of the water, and launching the rocket from said inner hull.

17. In a system for deploying and launching a rocket at sea wherein a capsule containing a rocket and launching means is tethered underwater by an anchor pod with release means between said anchor pod and s id capsule to permit the capsule to rise to the surface of the water to launch the rocket, the improvement comprising, a capsule for underwater positioning and launching of said rocket, said capsule having an outer hull of sufficient thickness and strength to withstand ambient water pressure, and an inner hull comprising longitudinal internal sides forming a rocket tube disposed concentrically within said outer hull, a gas impervious space formed between said inner and outer hulls, a pressurized gas contained within said space whereby said capsule possesses a positive buoyancy.

18. The system of claim 17 including, a removable top cover attached at a capsule top end closest to the water's surface.

19. The system of claim 17 including, a gas impervious diaphragm connected between said inner and outer hulls.

20. The system of claim 17 including, a hemispherically shaped capsule bottom secured to the bottom of said inner and outer hulls.

21. The system of claim 17 including, a plurality of stiffeners radially disposed within said space around the inner periphery of said outer hull a predetermined distance from one another.

22. The system of claim 21 including, a plurality of supports disposed around the outer periphery of said inner hull a predetermined distance from one another, wherein each of said supports is connected to a respective stiffener by means of a slip joint.

23. The system of claim 17 including, a removable top cover attached at a capsule top end closest to the water's surface, and a gas impervious diaphragm connected between said inner and outer hulls.

24. The system of claim 23 including, a hemispherically shaped capsule bottom secured to the bottom of said inner and outer hulls.

25. The system of claim 24 including, a plurality of stiffeners radially disposed within said space around the inner periphery of said outer hull a predetermined distance from one another, and a plurality of supports disposed around the outer periphery of said inner hull a predetermined distance from one another, wherein each of said supports is connected to a respective stiffener by means of a slip joint.

* * * * *